US011041413B2

(12) United States Patent
Lancefield et al.

(10) Patent No.: US 11,041,413 B2
(45) Date of Patent: Jun. 22, 2021

(54) HYBRID DUAL ELECTRIC AND HYDRAULICALLY OPERATED PHASER

(71) Applicant: Mechadyne International Ltd., Oxfordshire (GB)

(72) Inventors: Timothy Mark Lancefield, Oxfordshire (GB); David Arthur Bedborough, Oxfordshire (GB); Ian Methley, Oxfordshire (GB)

(73) Assignee: Mechadyne International Ltd., Oxfordshire (GB)

( * ) Notice: Subject to any disclaimer, the term of this patent is extended or adjusted under 35 U.S.C. 154(b) by 0 days.

(21) Appl. No.: 16/863,241

(22) Filed: Apr. 30, 2020

(65) Prior Publication Data

US 2020/0355096 A1 Nov. 12, 2020

(30) Foreign Application Priority Data

May 9, 2019 (EP) ..... 19173473

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34479* (2013.01); *F01L 2001/34483* (2013.01); *F01L 2001/34489* (2013.01)

(58) Field of Classification Search
CPC ..... F01L 1/3442; F01L 1/047; F01L 1/352; F01L 2001/34479; F01L 2001/34483; F01L 2001/34489; F01L 2001/34493
See application file for complete search history.

(56) References Cited

U.S. PATENT DOCUMENTS

2009/0120388 A1* 5/2009 Lee ..... F01L 1/352 123/90.11

FOREIGN PATENT DOCUMENTS

| | | | |
|---|---|---|---|
| DE | 10 2018 111996 | A1 | 4/2019 |
| WO | 2010/086799 | A1 | 8/2010 |
| WO | 2011/010241 | A1 | 1/2011 |
| WO | 2012/109013 | A2 | 8/2012 |

OTHER PUBLICATIONS

EPO Search Report; The Hague; Sep. 9, 2020.

* cited by examiner

*Primary Examiner* — Zelalem Eshete
(74) *Attorney, Agent, or Firm* — Patshegen IP LLC; Moshe Pinchas

(57) ABSTRACT

A hybrid dual phaser assembly is disclosed for mounting to an engine camshaft to allow the timing of two sets of cam lobes to be phased independently of one another relative to a crankshaft of the engine. The phaser assembly comprises an electrically operated phaser having intermeshing gears for transmitting torque to the camshaft and a phase control input driven by an electric motor to be mounted coaxially with the camshaft, and a hydraulically operated phaser having vanes movable within arcuate cavities. The cavities of the hydraulically operated phaser are defined in part by an annular member that radially surrounds, and axially overlaps, a gear of the electrically operated phaser, which gear is separate from the annular member and forms radially inner boundary walls of the cavities.

9 Claims, 4 Drawing Sheets

HYBRID DUAL ELECTRIC AND HYDRAULICALLY OPERATED PHASER

FIELD

The present invention relates to a phaser for acting on two groups of cam lobes of a valve train of an internal combustion engine to change the phases of each of the two groups of lobes independently of one another relative to the phase of the engine crankshaft. Such a system is herein referred to as a dual phaser.

BACKGROUND

The use of phasers is becoming increasingly widespread on both gasoline and diesel engines. In the past, hydraulically operated phasers have offered a compact and cost-effective solution. However, more recently, electrically operated phasers have become popular due to the functional advantages that they offer. These advantages include (i) faster response time, (ii) more consistent response times over all engine operating conditions, particularly low temperatures when oil viscosity reduces the performance of hydraulically operated phasers, and (iii) reduced oil consumption and oil pump power consumption.

An electrically operated phaser generally consists of two main components, namely a gear set or harmonic drive that is mounted to the engine camshaft, and an electric motor which is mounted to a stationary part of the engine and positioned coaxially with the camshaft. There may be a drive coupling (such as an Oldham coupling) to allow for any small misalignment between the axes of the motor and the camshaft. Phase is adjusted using an electrically operated phaser by varying the speed of the electric motor relative to that of the camshaft. If the motor speed is synchronized with camshaft speed, then the prevailing phase setting is maintained. Reducing the motor speed relative to the camshaft will cause the phaser to move in one direction, increasing the motor speed will cause the phaser to move in the other direction. A typical example of an electrically operated phaser is to be found in U.S. Pat. No. 8,682,564.

In some variable valve systems, such as that shown in EP 1417399, a phaser is used to adjust the valve lift profile characteristics. In such a system, operation of the phaser affects engine power output and the faster response of an electrically operated phaser would offer drivability advantages.

Many twin camshaft engines are now being designed with multiple phasers and, in some cases, these are of different types, one camshaft utilizing a cost-effective hydraulically operated phaser whilst the other uses an electrically operated phaser for its additional speed and consistency. For example, some engines utilize an electrically operated phaser to control the intake valve timing and a hydraulically operated phaser to control the exhaust valve timing.

EP 3141711 shows a hybrid dual phaser having an electrically operated phaser and a hydraulically operated phaser combined into a single unit for independently controlling the timing of two groups of cam lobes mounted to an adjustable camshaft, which is also referred to herein as a concentric or as an assembled camshaft. This device could be applied to an engine having a single camshaft to allow independent control of intake and exhaust valve timing or it could be applied to an engine with a cam summation valve train system such that one output of the dual phaser controls valve lift and duration whilst the other output controls the lift timing.

The dual phaser of EP 3141711 shows how the hydraulic and electric sections of a hybrid phaser can be arranged and connected axially, but, in some applications, there is limited axial space available making it difficult to implement such a solution.

OBJECT OF THE INVENTION

The invention therefore seeks to provide a hybrid dual phaser, comprised of a hydraulically operated phaser in combination with an electrically operated phaser, that has a reduced axial length and that offers a significant package space advantage in some applications.

SUMMARY OF THE INVENTION

According to the present invention, there is provided a hybrid dual phaser assembly for mounting to an engine camshaft to allow the timing of two sets of cam lobes to be phased independently of one another relative to a crankshaft of the engine, wherein the phaser assembly comprises an electrically operated phaser having intermeshing gears for transmitting torque to the camshaft and a phase control input driven by an electric motor to be mounted coaxially with the camshaft, and a hydraulically operated phaser having vanes movable within arcuate cavities, wherein the cavities of the hydraulically operated phaser are defined in part by an annular member that radially surrounds, and axially overlaps, a gear of the electrically operated phaser, which gear is rotatable relative to the annular member and forms radially inner boundary walls of the cavities.

By "axially overlaps" it is meant that at least one plane normal to the axis of rotation of the dual phaser assembly passes through both the electrically operated phaser and the hydraulically operated phaser. In this way, a dual phaser assembly of the invention combines an electrically operated phaser with a hydraulically operated phaser by arranging the arcuate working chambers radially around the electrically operated phaser in the same plane normal to the axis of rotation of the phaser. Packaging the electrically operated phaser radially inside the vane phaser minimizes the axial packaging space requirement whilst allowing the available radial space to be fully utilized.

The electrically operated phaser is controlled by the electric motor, which is mounted coaxially with the camshaft and the hydraulically operated phaser may be controlled by oil feeds connected to a proportional control valve via oil drillings in the camshaft.

BRIEF DESCRIPTION OF THE DRAWINGS

The invention will now be described further, by way of example, with reference to the accompanying drawings, in which.

DETAILED DESCRIPTION OF THE DRAWINGS

Figure 1:
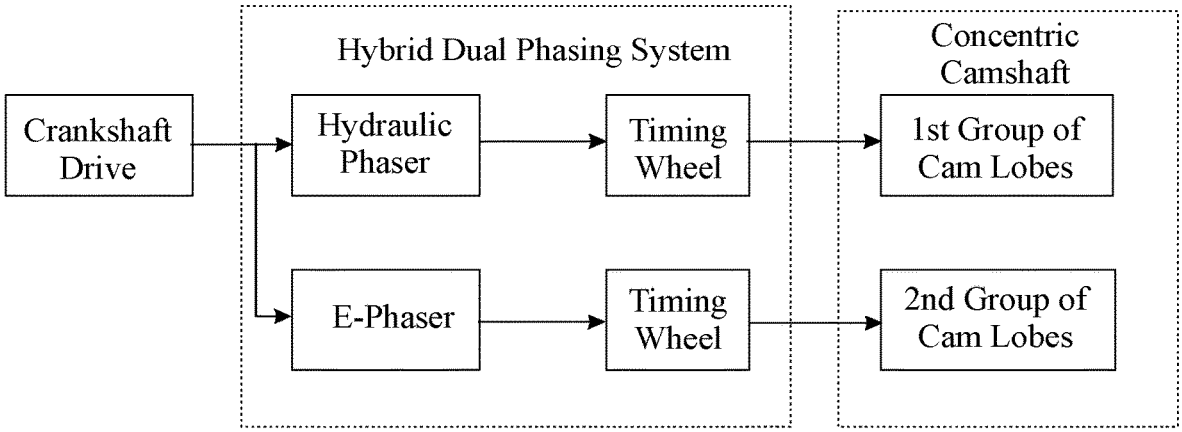
FIG. 1 is a drive diagram relating to a first embodiment.

The drive configuration of a first embodiment of the invention is shown in FIG. 1. Drive from the engine crankshaft is applied to two phasers actuated in parallel, each of the phasers being connected for rotation with a respective timing wheel and driving a respective set of cam lobes. This drive configuration differs from the configuration shown in FIG. 6 that is employed by the second embodiment of the invention. In the case of the configuration of FIG. 6, the phaser of the second set of cam lobes is connected in series, instead of in parallel, with the phaser driving the first set of cam lobes. In this way, the first phaser acts on both sets of cam lobes, while the second alters the relative phase between the first and the second set of cam lobes.

The construction of the phaser of the first embodiment of the invention is shown in FIGS. 2 to 5. The dual phaser of the first embodiment comprises an electrically operated phaser and a hydraulically operated phaser disposed in overlapping axial planes with the hydraulically operated phaser radially surrounding the electrically operated phaser. The drive input to both the hydraulic and electrically operated phasers comprises a sprocket 111 driven by the engine crankshaft (not shown) that also forms a rear end-plate 110 of the hydraulically operated phaser. This rear end plate 110 is fixed for rotation with a front-end plate 112 of the hydraulically operated phaser via three vanes 114 and clamping screws 116. The front-end plate 112 also serves as the drive input to the electrically operated phaser. The front end plate 112 is also formed with an internal gear 118 that serves as the input gear of the electrically operated phaser and drives the output gear 136 via an internal gearset 120 that is driven by an external motor (designated 180 in FIG. 4) to rotate epicyclically relative to the input gear 118 and the output gear 136.

The drive output of the hydraulically operated phaser is formed as an annular plate 122 partially defining three arcuate cavities 124. The inner radial surface of each cavity 124 is defined by the outer surface of the output member 136 of the electrically operated phaser. Each cavity 124 contains one of the vanes 114 connecting the front and rear plates 110,112. The three vanes 114 form a seal between the surface of the output gear 136 and the surface of the annular plate 122. The rear end plate 110 of the dual phaser is provided with three large slots 126 to allow access for a drive connection from the hydraulically operated phaser output plate 122 to the camshaft 160.

Timing feedback from the hydraulically operated phaser is provided by a timing wheel 130 integral to the annular plate 122, while timing feedback from the electrically operated phaser is provided by a timing wheel 134 formed as a plate fitted to the front of the dual phaser. This timing wheel 134 is connected for rotation with the electrically operated phaser output via three projections 138 on the output gear 136 of the electrically operated phaser that pass with clearance through cutouts 144 in the front plate 112 of the hydraulically operated phaser and are engaged by three small fixing screws 142 to secure the timing wheel 134 in position.

A bias spring 150 mounted to the rear end plate 110 of the phaser (shown only in FIG. 4) engages with the output plate 122 of the hydraulically operated phaser to provide a bias torque on the hydraulically operated phaser which can counteract the inherent drag-torque of the camshaft.

Figure 3:
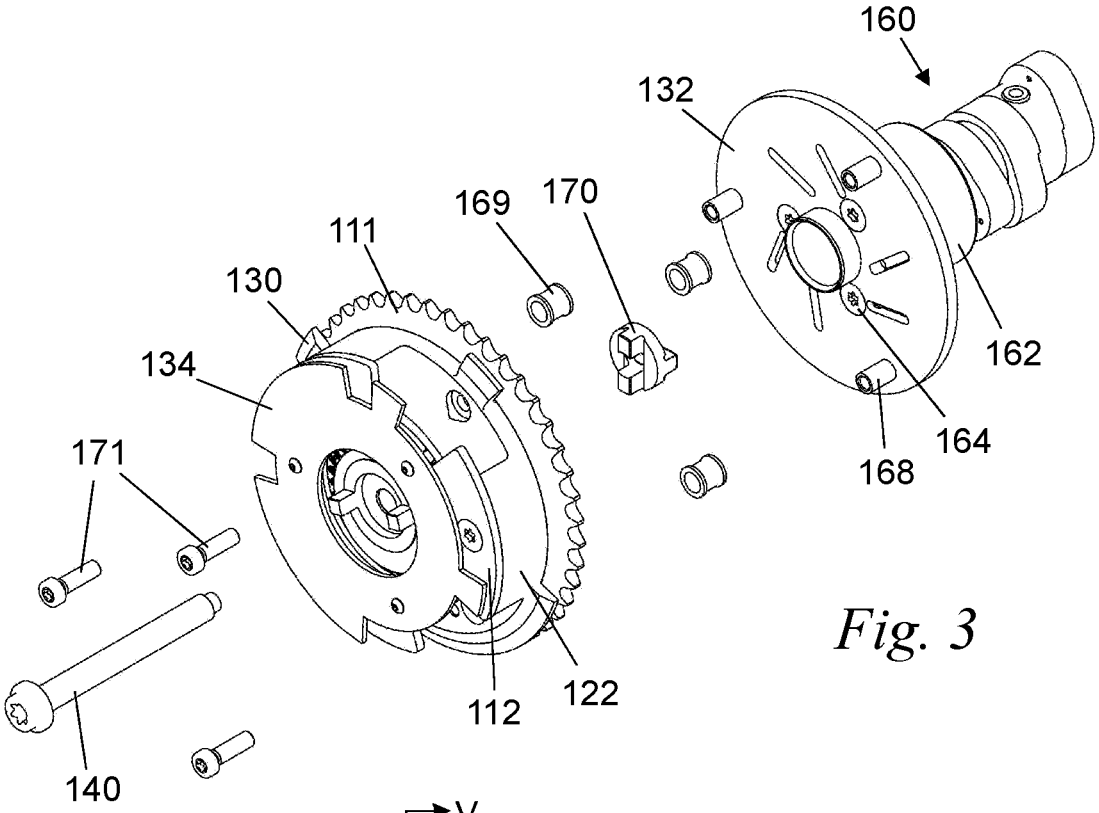
FIG. 3 is an exploded view showing the manner in which the dual phase of FIG. 2 is assembled to a camshaft.
Figure 4:
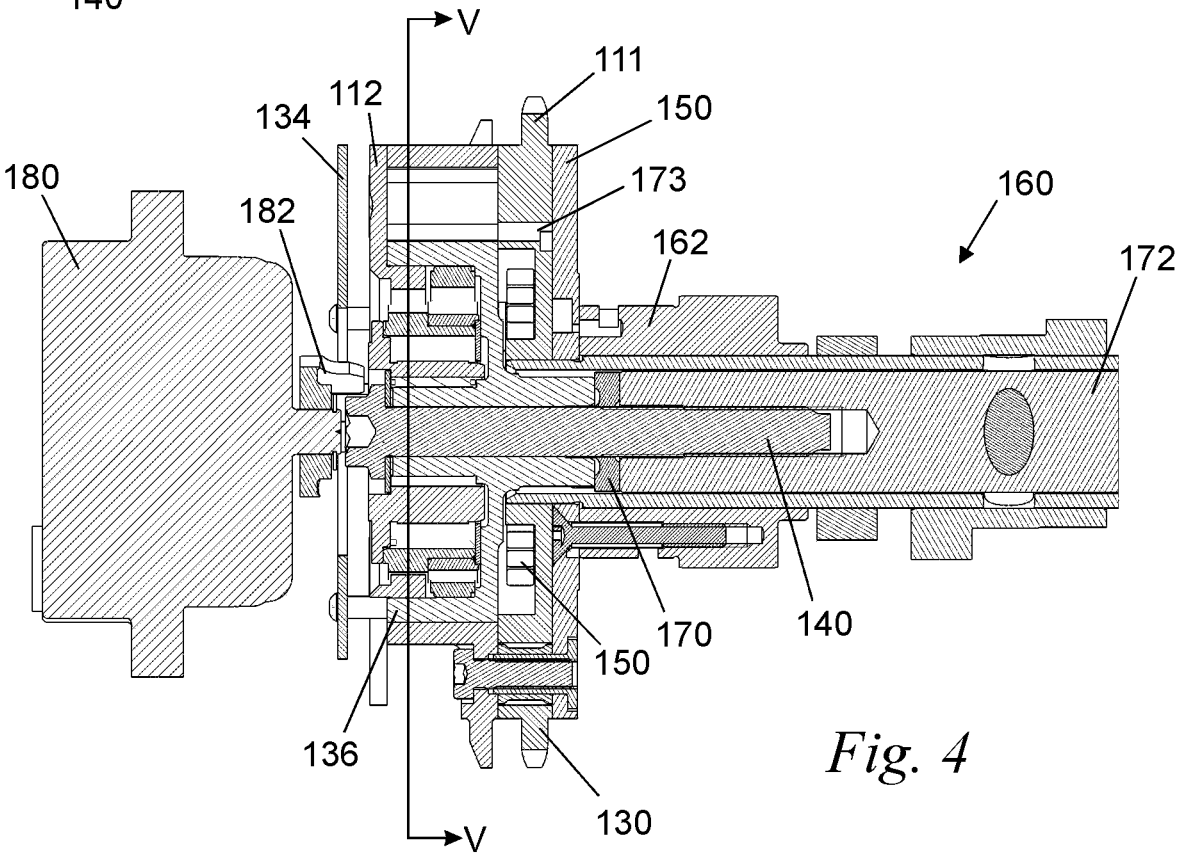
FIG. 4 is a section of the dual phaser of the first embodiment taken through the axis of the camshaft in the plane designated IV-IV in FIG. 5.

FIGS. 3 and 4 illustrate how the dual phaser assembly is mounted to a concentric camshaft, generally designated 160, to provide independent timing control of two sets of cam lobes.

A phaser mounting plate 132 is fitted to the camshaft front bearing 162 via three fixing bolts 164, and this mounting plate provides three spigots 168, fitted with three bushes 169, for connection to the output plate 122 of the hydraulically operated phaser, the entire dual phaser being secured in place by three screws 171. The drive connection between the electrically operated phaser output gear 136 and the inner driveshaft of the camshaft is achieved via a drive coupling 170, such as an Oldham coupling, that can transmit drive torque without imposing any radial position constraint between the phaser and the inner shaft 172 of the camshaft 160, and a fixing bolt 140 to secure the axial position of the inner shaft to the electrically operated phaser output gear 136.

FIG. 4 shows the dual phaser assembled to the concentric camshaft 160 and illustrates how oil feeds 173 to control the timing of the hydraulically operated phaser can be provided by the front bearing 162 of the camshaft. The electric motor 180 for controlling the electrically operated phaser timing is also shown, mounted concentrically to the camshaft 160 to a stationary part of the engine e.g. the front cover. The motor 180 engages with the electrically operated phaser via a drive coupling 182 and serves to rotate gear set 120 epicyclically relative to the input gear 118 and the output gear 136.

The internal gearset 120 has two gears that are fast in rotation with one another but have a different number of teeth. The first gear meshes with the internal input gear 118, and the second gear meshes with the output gear 136. The gear ratio between the input gear 118 and the first gear of the gearset 120 differs from the gear ratio between the second gear of the gearset 120 and the output gear 136. The difference between the two gear ratios causes the angular position of the output gear 136 to change relative to the input gear 118.

To maintain the same phase between the input from the crankshaft and the inner camshaft 172, the motor 180 must rotate the gearset 120 at the same speed as the input gear 118. If the motor 180 rotates at a speed different to the input gear 118, the first gear of the eccentric gearset 120 rotates and meshes at a different point within the input gear 118, causing rotation of the second gear and therefore the output gear 136. Once the desired phase is achieved, the motor 180 must again match the rotational speed of the input gear 118 to maintain the desired phase.

Figure 2:
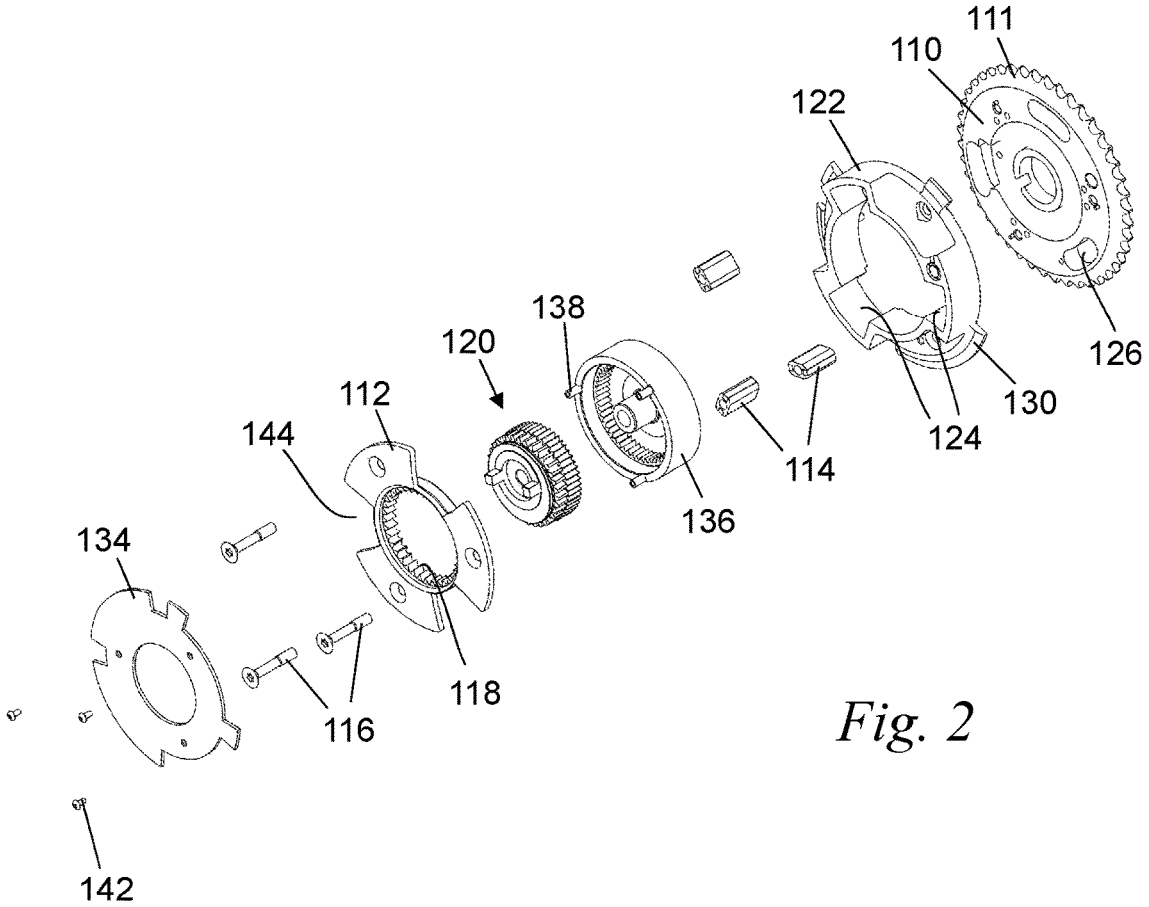
FIG. 2 is an exploded view of the first embodiment of a dual phaser.
Figure 5:
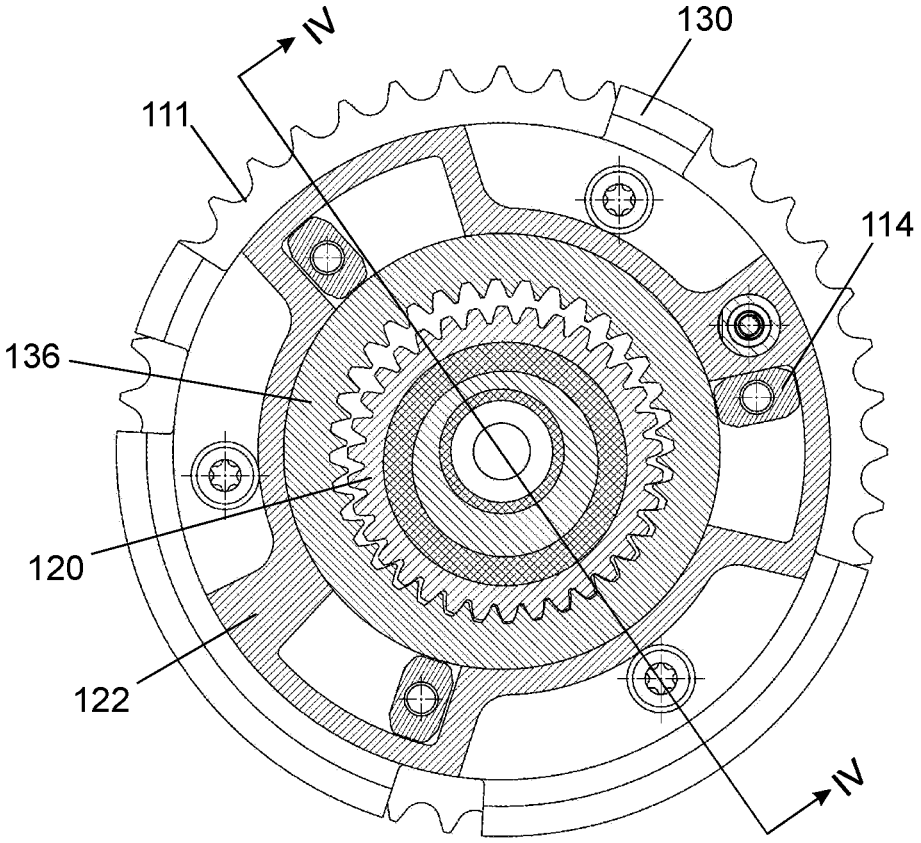
FIG. 5 is a section of the dual phaser of the first embodiment taken through the plane designated V-V in FIG. 4.

FIG. 5 shows a section in a plane through the dual phaser of FIGS. 2 to 4 and illustrates how the electrically operated phaser output gear 136 is radially supported by the hydraulically operated phaser output plate 122 but can rotate relative to it.

Description of the Second Embodiment

To avoid unnecessary repetition, components serving the same function in the different embodiments to be described herein have been allocated reference numerals with the same last two digits and will not be described again. Components of the first embodiment have numerals in the 100 series while those of the second, embodiments have numerals in the 200 series.

Figure 6:
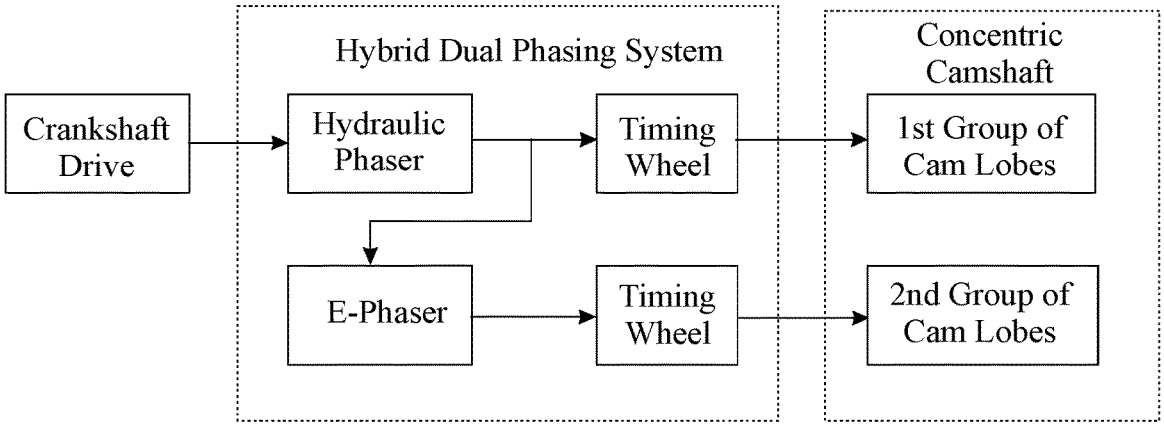
FIG. 6 is a drive diagram similar to that of FIG. 1 relating to a second embodiment.

The second embodiment adopts the alternative drive configuration shown in FIG. 6 in which one phaser acts on both sets of cam lobes. The engine crankshaft in this embodiment is connected to the input of the hydraulically operated phaser, the output of which acts on a first set of cam lobes directly. The output of the hydraulically operated phaser additionally provides the drive input of the electrically operated phaser, the output of which acts on the second set of cam lobes. Thus, the hydraulic phaser acts on all the cam lobes whereas the electric serves only to vary the phase of the second set of cam lobes relative to the phase of the first set of cam lobes.

Figure 7:
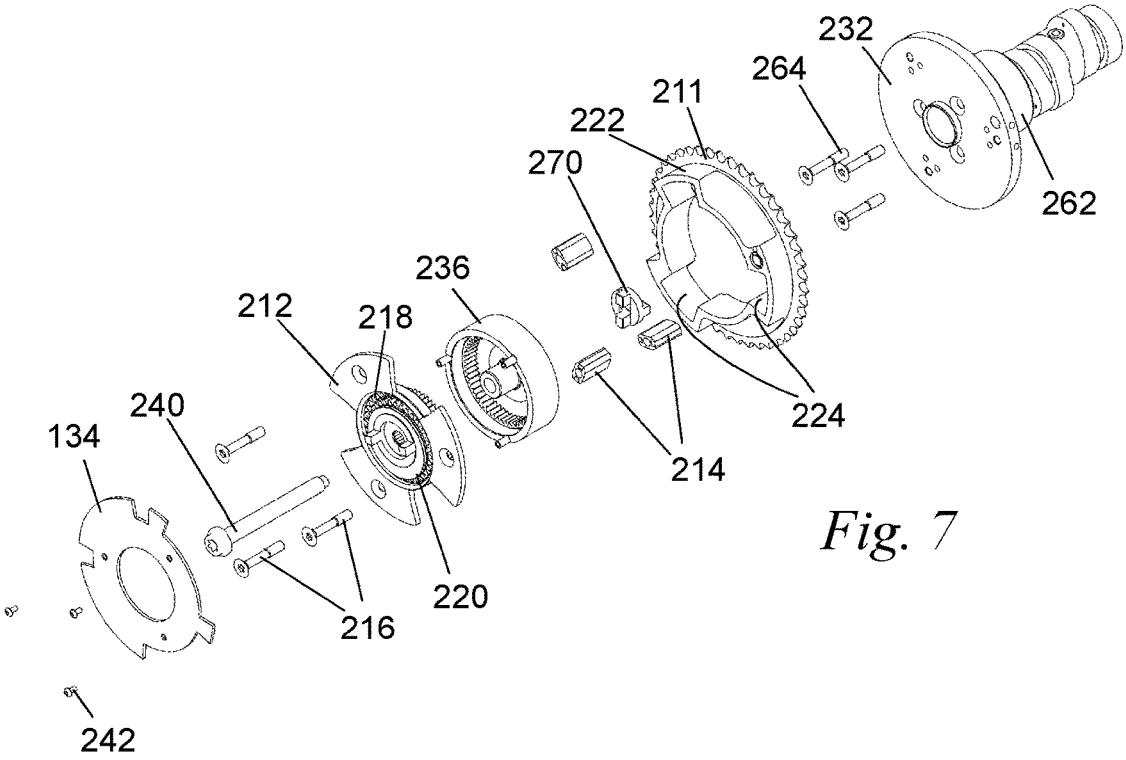
FIG. 7 is an exploded view of the second embodiment of a dual phaser.

In FIG. 7, a sprocket 211 that is driven by the engine crankshaft forms part of, or is mounted to, the annular plate 222 which partially defines the arcuate cavities 224 of the hydraulically operated phaser and serves as the input member of the hydraulically operated phaser. The vanes 214, movable within the cavities 224, are secured to both the phaser mounting plate 232 and to the front plate 212 by three clamping screws 216. The vanes 214, the mounting plate 232 and the front plate 212 thus serve as the output of the hydraulically operated phaser, which changes the phase of the first set of cam lobes relative to the crankshaft. As the front plate 212 has the input gear 218 of the electrically operated phaser formed within it, the output from the hydraulically operated phaser serves additionally as the input of the electrically operated phaser.

The timing wheel for the first set of cam lobes (not shown in FIG. 7) may be formed with or, connected for rotation with, either the mounting plate 232 or the front plate 212.

To maintain the same relative phase between the first and second set of cam lobes, the motor (not shown) must rotate at the same speed as the front plate 212. If the phase of the first set of cam lobes is to be changed relative to the phase of the second set of cam lobes, then the motor must compensate by adjusting its speed relative to the front plate 212.

The invention claimed is:

1. A hybrid dual phaser assembly for mounting to an engine camshaft to allow the timing of two sets of cam lobes to be phased independently of one another relative to a crankshaft of the engine, wherein the phaser assembly comprises an electrically operated phaser having intermeshing gears for transmitting torque to the camshaft and a phase control input driven by an electric motor to be mounted coaxially with the camshaft, and a hydraulically operated phaser having vanes movable within arcuate cavities, characterized in that the cavities of the hydraulically operated phaser are defined in part by an annular member that radially surrounds, and axially overlaps, a gear of the electrically operated phaser, which gear is rotatable relative to the annular member and forms radially inner boundary walls of the cavities.

2. A dual phaser assembly as claimed in claim 1, wherein sensor wheels are mounted for rotation with output members of the electrically operated phaser and the hydraulically operated phaser to generate timing signals for each of the two sets of cam lobes.

3. A dual phaser assembly as claimed in claim or 2, wherein a bias spring is provided to act upon the output member of the hydraulically operated phaser.

4. A dual phaser assembly as claimed in claim 1, further comprising a phaser mounting plate for mounting on a camshaft previously installed in an engine, the mounting plate being connectable to one of the electrically operated phaser and the hydraulically operated phaser subsequent to being mounted on the camshaft.

5. A dual phaser assembly as claimed in claim 4, wherein a sensor wheel is formed as part of, or directly mounted to, the phaser mounting plate.

6. A dual phaser assembly as claimed in claim 1, wherein a drive connection between the electrically operated phaser output and a respective set of cam lobes comprises a drive coupling and a fixing bolt that passes through the drive coupling and acts to clamp the coupling axially between the dual phaser assembly and the camshaft.

7. A camshaft assembly comprising a dual phaser assembly as claimed in claim 1, mounted to a concentric camshaft on which the two sets of cam lobes are mounted coaxially.

8. A camshaft assembly as claimed in claim 7, wherein each of the electrically operated phaser and the hydraulically operated phaser has a respective input member to be driven in synchronism with the engine crankshaft and is operative to vary the phase of an output member connected to drive only a respective one of the two sets of cam lobes.

9. A camshaft assembly as claimed in claim 7, wherein the hydraulically operated phaser has an input member to be driven in synchronism with the engine crankshaft and an output member connected to drive an input member of the electrically operated phaser and one of the two sets of cam lobes, an output member of the electrically operated phaser being connected to drive the second set of cam lobes in order to vary the phase of the two sets of cam lobes relative to one another.

* * * * *